US005817972A

United States Patent [19]

Butt et al.

[11] Patent Number: 5,817,972

[45] Date of Patent: Oct. 6, 1998

[54] IRON OXIDE AS A COOLANT AND RESIDUE FORMER IN AN ORGANIC PROPELLANT

[75] Inventors: Ron J. Butt, Fountain Hills; Eldron L. Boehmer, Mesa, both of Ariz.

[73] Assignee: TRW Inc., Lyndhurst, Ohio

[21] Appl. No.: 556,334

[22] Filed: Nov. 13, 1995

[51] Int. Cl.[6] ..... C06B 23/04

[52] U.S. Cl. ..... 149/109.2; 149/110

[58] Field of Search ..... 149/109.2, 109.4; 264/3.4

[56] References Cited

U.S. PATENT DOCUMENTS

| | | | |
|---|---|---|---|
| 3,862,866 | 1/1975 | Timmerman et al. | 149/21 |
| 4,386,979 | 6/1983 | Jackson, Jr. . | |
| 4,604,151 | 8/1986 | Knowlton et al. | 149/35 |
| 5,035,757 | 7/1991 | Poole . | |
| 5,139,588 | 8/1992 | Poole . | |
| 5,198,046 | 3/1993 | Bucerius et al. . | |
| 5,449,424 | 9/1995 | Oliver et al. | 149/109.6 |
| 5,472,647 | 12/1995 | Blau et al. | 264/3.1 |
| 5,486,248 | 1/1996 | Taylor et al. | 149/109.6 |
| 5,489,349 | 2/1996 | Headley | 149/35 |
| 5,500,059 | 3/1996 | Lund et al. | 149/19.1 |
| 5,507,890 | 4/1996 | Swann et al. | 149/16 |
| 5,544,687 | 8/1996 | Barnes et al. | 149/83 |

*Primary Examiner*—Charles Jordan
*Assistant Examiner*—John R. Hardee
*Attorney, Agent, or Firm*—Tarolli, Sundheim, Covell, Tummino & Szabo

[57] ABSTRACT

A gas generating composition, particularly useful for inflating a vehicle occupant restraint, comprises an organic fuel, an oxidant, and iron oxide in an amount effective to provide a coolant function in the gas generating composition. At least a major portion of the iron oxide is substantially free of catalytic or paint grade material and has an average particle size in a narrow particle size distribution range greater than 100 microns.

18 Claims, 2 Drawing Sheets

IRON OXIDE AS A COOLANT AND RESIDUE FORMER IN AN ORGANIC PROPELLANT

FIELD OF THE INVENTION

The present invention relates to a gas generating composition which comprises an organic fuel and an oxidant for the organic fuel. The present invention is particularly useful for rapidly inflating a vehicle occupant restraint.

BACKGROUND OF THE INVENTION

A problem in using a non-azide, organic fuel in a gas generating composition is that it is easier to generate slag or clinker upon ignition of a gas generating composition including sodium azide than a gas generating material including an organic fuel. This is because the combustion temperature generally is lower with azide based gas generants, and the products of combustion have higher melting points than this combustion temperature. For example, the combustion temperature of a sodium azide/iron oxide based gas generant may be about 969° C., whereas an organic fuel based gas generant may have a combustion temperature as high as about 2,000° C. As a result, many ordinarily solid combustion products are liquid at the combustion temperature of an organic fuel based gas generant and therefore are difficult to filter from the gas stream. For example, potassium carbonate melts at 891° C. and sodium silicate melts at approximately 1,100° C.

It is also desirable to have a low combustion temperature or calorific output to minimize filter and combustion chamber erosion. At a high calorific output, expensive filters capable of withstanding the heat from the combustion of the gas generating material may be needed.

The calorific output of organic fuel based gas generants can be lowered by adding a coolant to the gas generating composition. However, the addition of a coolant tends to decrease the burn rate. It is generally desirable to have a fast burn rate for inflating a vehicle occupant restraint.

DESCRIPTION OF THE PRIOR ART

U.S. Pat. No. 4,386,979 discloses a gas generating composition comprising a cyanamide, an oxidant reactive with the cyanamide, and a coolant. A preferred oxidant is a salt such as sodium nitrate. Iron oxide is also listed as a possible oxidant. Preferred coolants are hydroxides and oxides such as those of aluminum and silicon. The coolant reduces the reaction temperature by endothermic decomposition and by the heat capacity of the decomposition products. The decomposition releases carbon dioxide which would otherwise be retained as sodium carbonate. The composition also can contain zero to 5% of a burn rate catalyst. Iron oxide is mentioned as a possible burn rate catalyst. Catalytic iron oxide, also known as paint grade iron oxide, typically has a small average particle size in the range of submicron to two microns.

U.S. Pat. Nos. 5,035,757 and 5,139,588 disclose a gas generating composition comprising a tetrazole fuel, for example 5AT, a nitrate, and 10%–40% paint grade iron oxide as a high melt point slag former. The fuel 5AT is relatively energetic compared to a cyanamide.

U.S. Pat. No. 5,198,046 discloses an azotetrazolate (GZT), a nitrate and 0.1%–5% catalytic iron oxide as a burn-off regulator. GZT is also a relatively energetic fuel.

SUMMARY OF THE INVENTION

The present invention is a gas generating composition for inflating a vehicle occupant restraint. The gas generating composition comprises an organic fuel, an oxidizer and a coolant. A preferred organic fuel is a cyanamide. A preferred oxidizer is a nitrate of an alkali metal, an alkaline earth metal or ammonia, present in an approximately stoichiometric ratio with respect to the cyanamide compound. The coolant is iron oxide ($Fe_2O_3$). The iron oxide preferably is present in an amount in the range of about 10% to about 25% based on the weight of the entire composition. At least a major portion of the iron oxide fraction is substantially free of catalytic grade or paint grade material. Preferably, at least a major portion of the iron oxide has an average particle size greater than 100 microns.

BRIEF DESCRIPTION OF THE DRAWINGS

The present invention and advantages thereof will become more apparent from the following description with reference to the accompanying drawings, in which.

DETAILED DESCRIPTION OF THE PRESENT INVENTION

Figure 1:
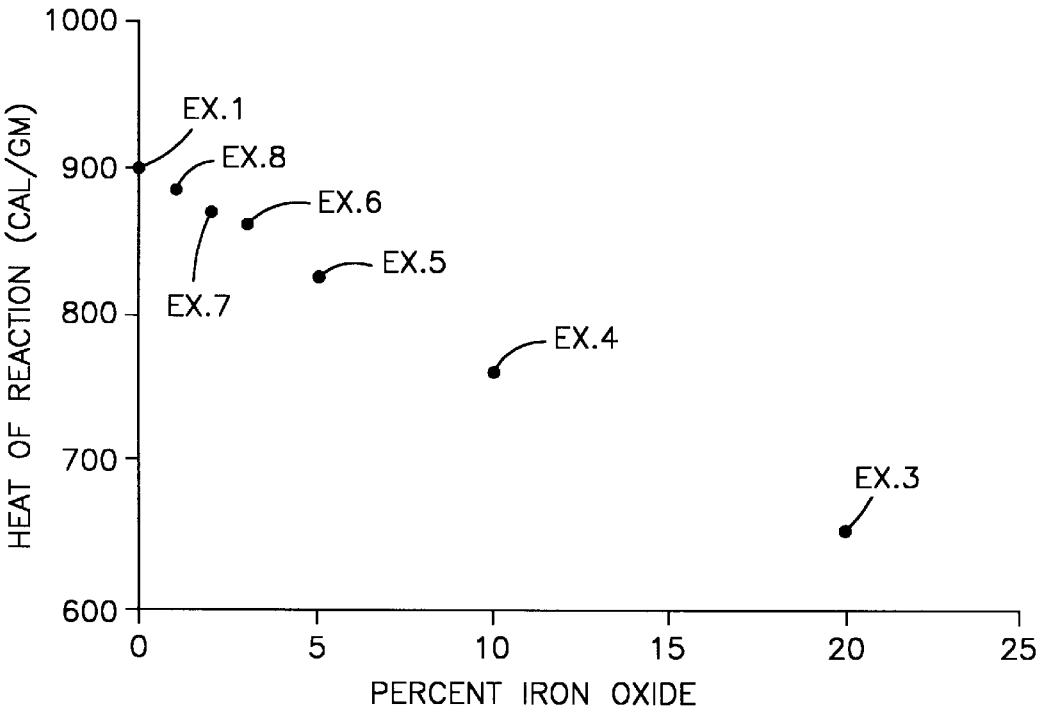
FIG. 1 is a graph comparing the percent of iron oxide in a gas generating composition against calorific output in calories per gram of gas generating composition.

In the present application, all percentages are weight percentages based on the weight of the gas generating composition unless otherwise stated. However, the gas generating composition weight, for purposes of the present application, means the combination of reactive components only, and does not include the weight of inert components which do not enter into the combustion reaction. Examples of inert components may be inert compaction aids and strengthening fibers.

The gas generating composition of the present invention is for a vehicle occupant restraint, such as an air bag which is inflated to protect a vehicle occupant in the event of a collision.

The present invention is not limited to a vehicle occupant restraint of any particular configuration. One configuration is disclosed in U.S. Pat. No. 4,902,036 to Zander et al. This patent discloses an air bag which is inflated between an occupant of a vehicle and an interior portion of the vehicle. The air bag can be installed in the steering wheel of the vehicle. A gas generating composition in the form of grains is stored within a housing. The gas generating composition, on combustion, produces a quantity of gaseous combustion products which inflate the air bag. The housing has an igniter which, upon ignition, ignites the gas generating grains.

The gas generating grains have a generally toroidal disc-like configuration with a cylindrical exterior and an axially extending hole. They are positioned in the housing in a stacked relationship with the axially extending holes in alignment. The holes are designed to receive either the igniter or the products of combustion from the igniter. Each grain has generally flat opposed surfaces and protuberances on such surfaces which space one grain slightly from another. This configuration of the grains promotes a uniform combustion of the gas generating material. Examples of other configurations well known to those skilled in the art can also be used.

The grains can be ignited by any conventional igniter. One conventional igniter is shown in U.S. Pat. No. 4,902,036. This igniter comprises a squib. The squib contains a small charge of an ignitable material. Electric leads convey a current to the squib. The current is provided when a sensor, which is responsive to an event indicative of a vehicle collision, closes an electrical circuit that includes a power source. The current generates heat in the squib which ignites the ignitable material. The igniter also has a canister which contains a rapidly combustible pyrotechnic material such as boron potassium nitrate. The rapidly combustible pyrotechnic material is ignited by the small charge of ignitable material. Ignition of the rapidly combustible pyrotechnic material provides the threshold energy required to ignite the gas generating grains. Other ignition systems capable of producing this threshold energy are well known and can be used with the present invention.

The grains of the gas generating composition are made by blending together components of the gas generating composition, and then pressing the blended components into the desired configuration. Preferably, the grains are made using a dry process, wherein the components of the gas generating composition are dry blended together, and then compacted into the desired configuration, while still in a dry state. Alternatively, the grains can be blended and formed using a wet process. In this process, the components are mixed with a liquid medium such as water or ethanol to form a slurry. The slurry may be partially dried, and then formed into the desired configuration using a press or compactor having such configuration. The formed grains are then dried.

The vehicle occupant restraint of U.S. Pat. No. 4,902,036 also comprises a filter assembly in the flow path between the combustion chamber and the air bag. The filter assembly functions to remove solid products of reaction from the combustion gases and prevent their entry into the air bag. The filter also cools the products of reaction.

The composition in accordance with the present invention comprises a fuel component, an oxidizer for the fuel component, and a coolant. The fuel component is an organic fuel. The present invention is particularly useful with a cyanamide compound. Examples are: dicyandiamide ($C_2H_4N_4$); melamine ($C_3N_3(NH_2)_3$); cyanamide salts such as calcium cyanamide (CaNCN) and zinc cyanamide (ZnNCN); hydrogen cyanamide salts such as calcium hydrogen cyanamide ($Ca(HNCN)_2$), and sodium hydrogen cyanamide ($NaHCN_2$); and mixtures of the foregoing compounds. These fuels can be characterized as relatively less energetic than other organic fuels.

The composition of the present invention can include more energetic organic fuels, such as those containing one or more oxygen atoms. Examples are nitrocyanamide compounds such as nitroguanidine ($CH_4O_2N_4$), nitrates such as triaminoguanidine nitrate, triazoles and tetrazoles. Other fuels useful in the composition of the present invention will be apparent to those skilled in the art.

A cyanamide compound is preferred in the gas generating composition of the present invention. This is because the cyanamides are non-toxic, non-corrosive, chemically stable, and insensitive to shock and friction. The cyanamide compounds are also currently manufactured in large production quantities and are readily available at low cost. Also, the gaseous products of combustion of the cyanamides are nonhazardous, and high gas yields are obtained. A particularly preferred cyanamide compound is dicyandiamide.

The cyanamide compound preferably is present in the gas generating composition of the present invention in an amount of about 22% to 29% by weight based on the weight of the gas generating composition, excluding inert components.

The oxidizer for reaction with the cyanamide compound is a nitrate of an alkali metal, alkaline earth metal, or ammonia. Preferred oxidizers are sodium nitrate, potassium nitrate and strontium nitrate. These nitrates are non-deliquescent and, on reaction with a cyanamide compound, produce products of reaction which are non-toxic.

The oxidizer is present in an amount which is approximately stoichiometric with respect to the fuel compound. If the gas generating composition is fuel rich, i.e., having more fuel than that necessary to react with the oxidizer, or fuel lean, i.e., having less fuel than necessary to react with the oxidizer, undesirable products of combustion may result. On a weight basis, the oxidizer preferably is present in an amount of about 52% to about 71% based on the weight of the gas generating composition excluding inert components.

The coolant of the gas generating composition of the present invention is iron oxide ($Fe_2O_3$). The iron oxide functions as a coolant essentially by providing a heat sink for absorbing calories produced in the combustion reaction.

The amount of iron oxide coolant in the gas generating composition is important. The iron oxide has to cool the reaction products from the combustion of the fuel and oxidizer enough to form a significant amount of a solid filterable slag. It is also necessary to cool the reaction products to minimize hardware erosion in the inflator for the vehicle occupant restraint. Preferably, the iron oxide coolant is present in the gas generating composition of the present invention in the amount of about 10% to about 25% based on the weight of the gas generating composition excluding inert material.

The particle size of the iron oxide fraction is also important. The iron oxide fraction preferably consists of a major portion which is substantially free of fine particle size material. By "fine particle size material", it is meant catalytic grade or paint grade material. This material has an average particle size that can be characterized as sub-micron to about two microns in diameter. By "major portion", it is meant more than 50%.

A critical consideration in the use of a gas generating composition is the burn rate of the composition. The gas generating composition has to burn and produce gas at a fast enough rate to inflate the air bag in time to protect the vehicle occupant.

If catalytic grade or paint grade iron oxide is used in the gas generating composition of the present invention, in an amount in the range of about 10% to 25%, it was found that the burn rate of the gas generating composition was depressed substantially along with the reduction in calorific output of the gas generating composition.

While not intending to be bound by theory, it is believed that the catalytic or paint grade iron oxide, when present in an amount of five percent or more, creates a plurality of successive barriers to the flame front advancing through a grain comprised of the gas generating composition. By using particle size coolant material significantly larger than catalytic or paint grade, passageways are provided within the grains through which the flame front can advance.

preferably, the iron oxide fraction has a major portion which has an average particle size greater than 100 microns.

The following reaction (1) illustrates the combustion of dicyandiamide with sodium nitrate without any coolant present in the reaction mixture.

$$40C_2H_4N_4+96NaNO_3 \rightarrow 32CO_2+80H_2O+128N_2+48Na_2CO_2 \quad (1)$$

On a weight basis, the gas generating composition of reaction (1) comprises about 29% dicyandiamide and about 71% sodium nitrate.

These proportions are stoichiometric. As will be shown in the following Example 1, this reaction produces a high calorific output and only a small percent of filterable slag.

The following reaction (2) illustrates the combustion of dicyandiamide and sodium nitrate with 18 mols of iron oxide ($Fe_2O_3$) present in the reaction mixture.

$$40C_2H_4N_4+96NaNO_3+18Fe_2O_3 \rightarrow 36Na_2O.\ FeO+(2)$$

$$68CO_2+12Na_2CO_3+80H_2O+128N_2+90_2$$

On a weight basis, the gas generating composition in reaction (2) consists of about 23.3% dicyandiamide, about 56.7% sodium nitrate, and about 20% iron oxide. The ratio of dicyandiamide to sodium nitrate in reaction (2) is stoichiometric.

Reaction (2), as will be shown in the following Examples, produces a lower calorific output and a higher solid slag formation than reaction (1). However, despite a reduction in calorific output, good burning rates can be obtained.

In reaction (2), a portion of the iron oxide reacts with sodium carbonate reaction product to form sodium/ferrous oxides. Reaction (2) shows that only 12 mols of sodium carbonate are produced compared to 48 mols in reaction (1). The slag formation from reaction (2) is due in part to the formation of sodium/ferrous oxide. The sodium/ferrous oxide has a higher melting point than the sodium carbonate, and therefore forms more filterable solid slag product than does the sodium carbonate at the temperature of the reaction product.

It can also be noted from reaction (2) that in addition to decreasing the production of sodium carbonate while producing the more easily filterable sodium/ferrous oxide, the addition of iron oxide produces twice as much carbon dioxide gas as well as some oxygen gas. Thus, not only does the iron oxide produce a more easily filterable combustion product, but it also increases the gas yield.

The following Examples illustrate the present invention.

Examples 1–14

Mixtures of dicyandiamide, sodium nitrate, and zero to 20 weight percent iron oxide coolant were prepared having the weight percentages of iron oxide given in the following Table. The weight percentages given in the Table are based on the total weight of reactive components in the composition. The ratio of dicyandiamide to sodium nitrate in all of the Examples was stoichiometric. The components were dry blended and strands were prepared by compression molding the blend. The density of the strands at the 20% level of iron oxide varied from about 1.94 to 2.12 grams per cc. At the zero to 10% level of iron oxide, the density varied from about 1.82 to 1.9 grams per cc.

The mixtures were tested for burn rate (Rb) and calorific output (Hr) in a pressurized bomb. Measurements were obtained at both 1,000 psi and 2,000 psi in the bomb. The percent slag formation was also determined. The burn rate (in inches per second) was determined from the bomb pressure curve, and the calorific output (in calories per gram of gas generating material) was measured using a calorimeter, following conventional procedures.

In the Table, the designation "$2\mu Fe_2O_3$" means iron oxide having an approximate average particle size of about two microns. The designation "$200\mu Fe_2O_3$" means the average particle size of material obtained between a 100 mesh screen (150 microns) and a 60 mesh screen (250 microns). The designation "$335\mu Fe_2O_3$" means the average particle size of material obtained between a 60 mesh screen (250 microns) and a 40 mesh screen (420 microns). The iron oxide was washed, so that samples having narrow particle size distribution curves were obtained. By "narrow particle size distribution curves", it is meant the graph of the frequency of particles at different sizes within a relatively narrow range, preferably a range of less than about two hundred microns.

TABLE

| Example | Total $Fe_2O_3$ % | Rb @ 2000 | Rb @ 1000 | Hr | Percent $2\mu$ $Fe_2O_3$ in Blend | Percent $200\mu$ $Fe_2O_3$ in Blend | Percent $335\mu$ $Fe_2O_3$ in Blend | Percent Slag |
|---|---|---|---|---|---|---|---|---|
| 1 | 0 | 1.38 | 1.56 | 899 | 0.0 | 0 | 0 | 19.5 |
| 2 | 4 | 1.27 | 1.57 | 843 | 4.0 | 0 | 0 | 27.0 |
| 3 | 20 | 0.806 | 1.03 | 654 | 20.0 | 0 | 0 | 51.6 |
| 4 | 10 | 1.07 | 1.31 | 762 | 10.0 | 0 | 0 | 23.3 |
| 5 | 5 | 1.29 | 1.54 | 827 | 5.0 | 0 | 0 | 27.0 |
| 6 | 3 | 1.33 | 1.55 | 863 | 3.0 | 0 | 0 | 20.5 |
| 7 | 2 | 1.31 | 1.61 | 872 | 2.0 | 0 | 0 | 15.8 |
| 8 | 1 | 1.41 | 1.65 | 886 | 1.0 | 0 | 0 | 12.1 |
| 9 | 20 | 1.03 | 1.187 | 657 | 4.0 | 16 | 0 | 34.9 |
| 10 | 20 | 0.998 | 1.216 | 652 | 0.0 | 20 | 0 | 45.1 |
| 11 | 20 | 1.52 | 1.6 | 665 | 0.0 | 0 | 20 | 36.7 |
| 12 | 20 | 1.11 | 1.45 | 677 | 6.0 | 0 | 14 | 40.5 |
| 13 | 20 | 0.96 | 1.24 | 666 | 10.0 | 0 | 10 | 47.0 |
| 14 | 20 | 1.2 | 1.56 | 668 | 4.0 | 0 | 16 | 26.0 |

Figure 2:
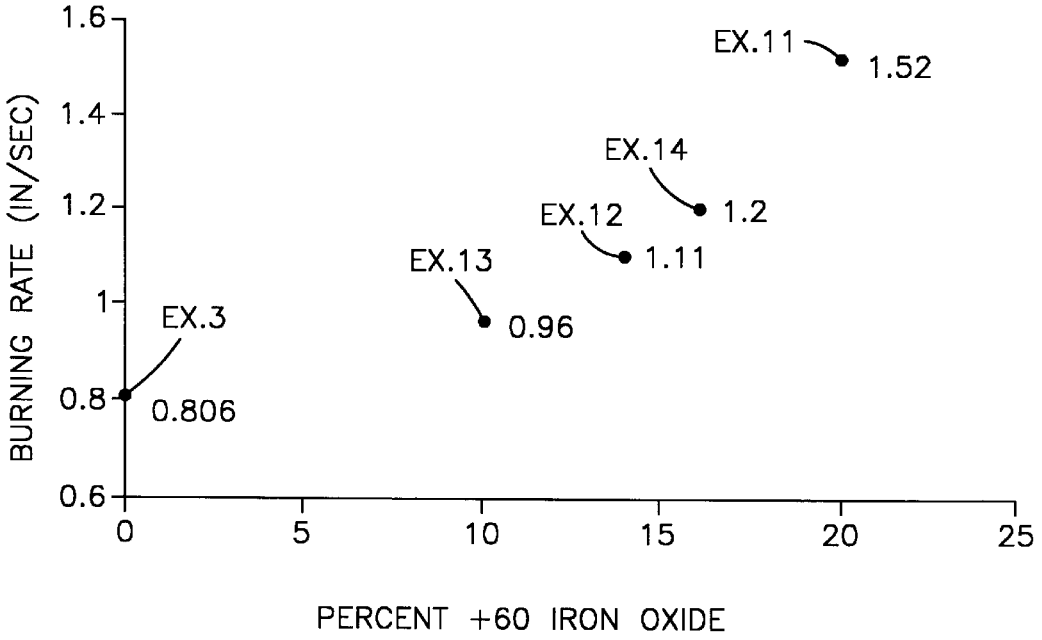
FIG. 2 is a graph comparing percent iron oxide having an average particle size of about 335 microns in a gas generating composition against burning rate in inches per second.
Figure 3:
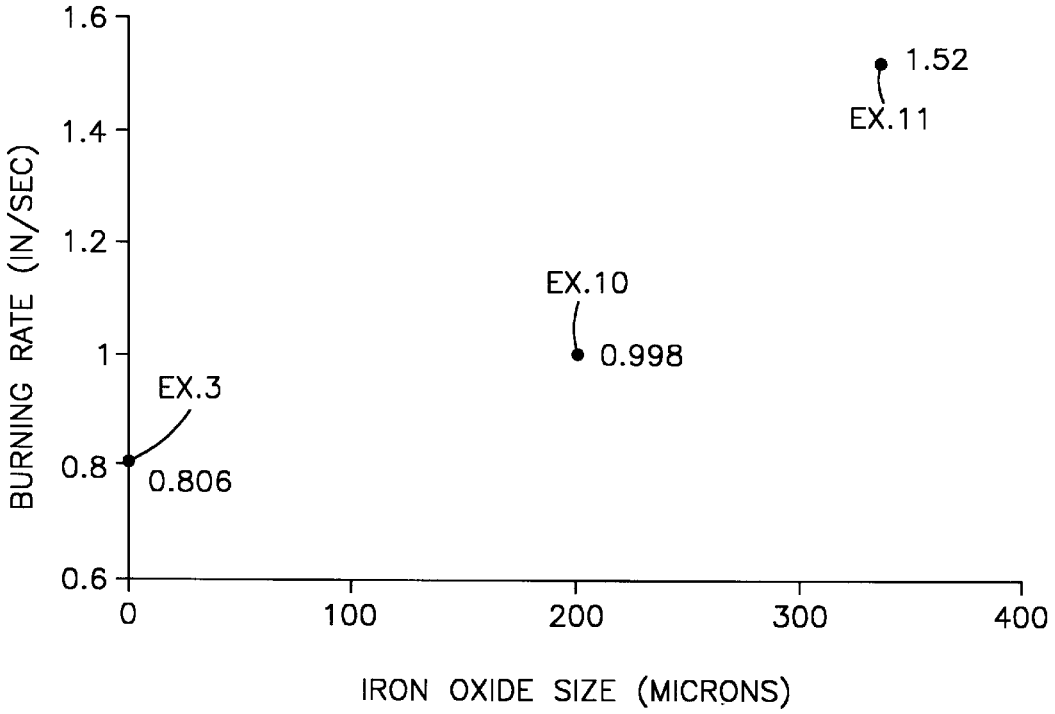
FIG. 3 is a graph comparing the iron oxide average particle size in microns against burning rate in inches per second.

Certain data taken at 1,000 psi is presented in graph form in FIGS. 1–3. Referring to FIG. 1, it can be seen that the calorific output (heat of reaction in calories per gram) was substantially depressed with increased amounts of iron oxide coolant up to 20%. For instance, at amounts of iron oxide coolant of zero percent (Ex. 1), 5% (Ex. 5), 10% (Ex. 4) and 20% (Ex. 3), the calorific outputs were 899, 827, 762 and 654 calories per gram, respectively.

Referring to the above Table, the percent slag formation (based on the weight of the gas generating composition) correspondingly increased with decreased calorific output, for instance from 19.5% in Example 1 (at zero percent iron oxide) to 23.3% in Example 4 (at 10% iron oxide) and 51.6% in Example 3 (at 20% iron oxide).

Referring to FIG. 2, it can be seen that despite a reduced calorific output produced by the use of added iron oxide coolant, the burn rate can surprisingly be increased, or essentially maintained, compared to the burn rate with no added iron oxide coolant, as the calorific output is depressed. All of the data presented in FIG. 2 was obtained using 20% added iron oxide coolant.

The difference between Examples 11, 12, 13 and 14 in FIG. 2 is the amount of large particle size iron oxide in the coolant fraction of the gas generating composition. In Example 13, the coolant fraction consisted of 10% catalytic or paint grade material and 10% 335 micron material (based on the weight of the gas generating composition).

In Example 12, the coolant fraction consisted of 6% catalytic or paint grade material and 14% 335 micron material. In Examples 14 and 11, the 335 micron material was increased to 16% and 20%, respectively, based on the weight of the gas generating composition.

At 10% 335 micron iron oxide (Example 13), the burn rate was 0.96 inch per second, whereas in Examples 12, 14 and 11, at 14%, 16% and 20% 335 micron iron oxide, the burn rates were 1.11, 1.2 and 1.52 inches per second, respectively. Referring to the above Table, the burn rate with no iron oxide present (Example 1) was 1.38 inches per second. The burn rate with 20% catalytic or paint grade iron oxide (Example 3) was 0.806 inch per second.

The burn rates of 1.11 and 1.2 of Examples 12 and 14 are considered acceptable and are surprisingly above what one would expect considering the depression in calorific output, and within the meaning of "essentially maintained". However, the most surprising aspect of the data of FIG. 2 is the significantly higher burn rate of 1.52 inches per second achieved in Example 11 (with 20% 335 micron iron oxide) compared to Example 1 with no iron oxide (1.38 inches per second). The higher burn rate was obtained despite a much lower calorific output, 665 calories per gram in Example 11 compared to 899 calories per gram in Example 1.

What the data of FIGS. 1 and 2 shows is that with the use of 10% to 25% large particle size iron oxide as a coolant, the calorific output can be substantially decreased, providing better clinker formation and hardware protection, without substantially sacrificing burn rate.

This relationship of particle size to burning rate is further illustrated in FIG. 3. Example 3, in FIG. 3, comprised 20% iron oxide coolant of catalytic or paint grade size. Examples 10 and 11, in FIG. 3, comprised 20% iron oxide coolant of 200 micron and 335 micron material, respectively. FIG. 3 shows a substantial increase in burning rate with increased coolant particle sizing, from 0.806 in Example 3 to 0.998 in Example 10 and 1.52 in Example 11.

If the particle size of the iron oxide is too large, for instance having an average particle size significantly above 335 microns, the beneficial effect of the use of iron oxide coolant appears to diminish, possibly due to poorer dispersing of the fuel and oxidant.

Based on the above and other data, a preferred iron oxide coolant fraction comprises at least about 10% iron oxide (based on the weight of the gas generating composition). Preferably, a major portion (more than about 50% by weight) of the iron oxide fraction has a narrow particle size distribution curve and is substantially free of catalytic or paint grade iron oxide. Preferably, at least about 50% of the iron oxide fraction has an average particle size greater than about 100 microns.

A preferred upper limit for the amount of iron oxide is 25%. At more than 25% iron oxide, the calorific output appears to become too depressed.

From the above description of the invention, those skilled in the art will perceive improvements, changes and modifications. Such improvements, changes and modifications within the skill of the art are intended to be covered by the appended claims.

Having described the invention, the following is claimed:

1. A gas generating composition for inflating a vehicle occupant restraint comprising:

(a) a dicyandiamide fuel;

(b) an oxidant for the fuel;

(c) coolant in an amount in the range of about 10% to about 25% based on the weight of the gas generating composition to cool the products of combustion of (a) and (b), said coolant being iron oxide ($Fe_2O_3$) and having a major portion which is substantially free of catalytic or paint grade iron oxide.

2. A vehicle occupant restraint comprising the gas generating composition of claim 1 in the form of grains.

3. The gas generating composition of claim 1 in the form of grains wherein said iron oxide coolant has an average particle size greater than 100 microns.

4. The composition of claim 3 wherein said average particle size of said iron oxide is at least 200 microns.

5. The composition of claim 4 wherein said average particle size of said iron oxide is at least 335 microns.

6. A method of decreasing the calorific output, increasing slag formation and promoting the burn rate of a gas generating composition which composition comprises an organic fuel, an oxidizer and a coolant, said method comprising the step of using as said coolant an iron oxide ($Fe_2O_3$) in the amount of about 10% to about 25% of the weight of the gas generating composition wherein said iron oxide has a major portion which is substantially free of catalytic or paint grade material and has an average particle size greater than 100 microns, wherein said organic fuel is dicyandiamide.

7. The method of claim 6 wherein said oxidizer is a nitrate of sodium, potassium, strontium, or combinations thereof.

8. The method of claim 7 wherein said average particle size of said major portion of said iron oxide is at least 200 microns.

9. The method of claim 8 wherein said average particle size of said major portion of said iron oxide is at least 335 microns.

10. A gas generating composition for inflating an air bag comprising combustion reactants consisting essentially of a fuel, an oxidizer, and a coolant, wherein the fuel is a dicyandiamide, the oxidizer is a nitrate of an alkali metal, alkaline earth metal or ammonia, and the coolant is iron oxide ($Fe_2O_3$) in the amount of about 10% to 25% based on the weight of the gas generating composition, and a major portion of said iron oxide is substantially free of catalytic or paint grade material and has an average particle size greater than 100 microns.

11. The composition of claim 7 wherein said average particle size of said major portion of said iron oxide is at least 200 microns.

12. The composition of claim 9 wherein said average particle size of said major portion of said iron oxide is at least 335 microns.

13. A vehicle occupant restraint comprising the gas generating composition of claim 10.

14. The gas generating composition of claim 10 in the form of grains prepared by the method comprising the steps of:

(a) blending the fuel, oxidizer, and iron oxide to form a mixture; and (b) compacting said mixture into said grain form.

15. The gas generating composition of claim 12 wherein said grains have a toroidal configuration comprising an outer cylindrical surface, an axial hole, and parallel spaced apart top and bottom planar surfaces at right angles to said outer cylindrical surface.

16. A vehicle occupant restraint comprising:

(a) an inflator;

(b) a gas generating composition in said inflator in the form of a cylindrical grain of a mixture of particulate components;

(c) said gas generating composition comprising a particulate fuel component, an inorganic oxidizer component and a coolant component wherein said fuel component is an organic fuel and the ratio of fuel component to oxidizer component is approximately stoichiometric and said coolant component is particles of iron oxide in an amount in the range of about 10% to about 25% based on the weight of the gas generating composition, said coolant component being substantially free of catalytic or paint grade particles and comprising a 50% or greater portion, based on the weight of coolant component, having a particle size greater than 100 microns.

17. The restraint of claim 16 wherein said coolant component has an average particle size greater than 200 microns.

18. The restraint of claim 16 wherein said grain is prepared by the method comprising the steps of:

(a) blending the fuel component, oxidizer component, and iron oxide component to form a mixture; and (b) compacting said mixture into said grain form.

* * * * *